US009617932B2

(12) United States Patent
Iwaya

(10) Patent No.: US 9,617,932 B2
(45) Date of Patent: Apr. 11, 2017

(54) TRANSPIRATION FUEL TREATMENT APPARATUS

(71) Applicant: MITSUBISHI JIDOSHA KOGYO KABUSHIKI KAISHA, Tokyo (JP)

(72) Inventor: Norifumi Iwaya, Obu (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 22 days.

(21) Appl. No.: 14/864,477

(22) Filed: Sep. 24, 2015

(65) Prior Publication Data

US 2016/0090924 A1 Mar. 31, 2016

(30) Foreign Application Priority Data

Sep. 25, 2014 (JP) ..... 2014-195791

(51) Int. Cl.
*F02M 25/08* (2006.01)
*F02D 41/00* (2006.01)

(52) U.S. Cl.
CPC ..... *F02D 41/004* (2013.01); *F02M 25/089* (2013.01); *F02M 25/0836* (2013.01); *F02M 25/0854* (2013.01); *F02M 25/0872* (2013.01); *F02D 41/003* (2013.01)

(58) Field of Classification Search
CPC ..... F02D 41/004; F02M 25/0836; F02M 25/0854; F02M 25/0872; F02M 25/089
USPC ..... 123/520, 519, 518, 516
See application file for complete search history.

(56) References Cited

U.S. PATENT DOCUMENTS 5,806,500 A * 9/1998 Fargo ..... F02M 25/089 123/198 D
5,860,458 A * 1/1999 Benjey ..... B60K 15/03519 137/202
7,823,610 B2 * 11/2010 King ..... B60K 15/03504 137/202
2004/0089275 A1 5/2004 Kidokoro et al.
2014/0137948 A1 * 5/2014 Hagen ..... B60K 15/03519 137/12

FOREIGN PATENT DOCUMENTS

JP 4110932 B2 7/2008

* cited by examiner

*Primary Examiner* — Mahmoud Gimie
(74) *Attorney, Agent, or Firm* — Birch, Stewart, Kolasch & Birch, LLP

(57) ABSTRACT

A transpiration fuel treatment apparatus, which can lower the internal pressure of a fuel tank in a relatively short time at the time of refueling, is provided. The transpiration fuel treatment apparatus comprises a fuel tank, a first sealing valve for sealing up a transpiration fuel within the fuel tank, and a second sealing valve for sealing up the transpiration fuel within the fuel tank at a position different from the position of the first sealing valve. The first sealing valve and the second sealing valve are opened before refueling of the fuel tank is started.

20 Claims, 4 Drawing Sheets

TRANSPIRATION FUEL TREATMENT APPARATUS

The entire disclosure of Japanese Patent Application No. 2014-195791 filed on Sep. 25, 2014 is expressly incorporated by reference herein.

TECHNICAL FIELD

This invention relates to a transpiration fuel treatment apparatus which introduces a transpiration fuel (evaporative fuel) within a fuel tank into an air intake system of an engine for combustion, thereby suppressing its discharge into the atmosphere.

BACKGROUND ART

A transpiration fuel which has occurred within a fuel tank poses a cause of air pollution. A vehicle loaded with an engine, therefore, generally has a transpiration fuel treatment apparatus installed therein for suppressing the discharge of the transpiration fuel into the atmosphere. The transpiration fuel treatment apparatus, for example, connects the fuel tank and an intake system of the engine by a purge pipe line equipped with a canister. In this configuration, the transpiration fuel generated within the fuel tank is once adsorbed to activated carbon within the canister and, in accordance with a manifold vacuum in the engine, the fuel adsorbed to the activated carbon is introduced into the intake system of the engine and burned together with fresh air.

In recent years, vehicles provided with drive motors along with engines, such as plug-in hybrid vehicles (PHEV) and hybrid electric vehicles (HEV), have been put to practical use. With such a vehicle with the drive motor, a period during which the engine is stopping, namely, the period during which no fuel can be introduced from the canister into the intake system of the engine, may last for a relatively long time. Thus, a so-called sealing transpiration fuel treatment apparatus, in which a sealing valve is provided between the fuel tank and the canister, and this sealing valve is in a closed state during the period of an engine halt, is under development.

With such a transpiration fuel treatment apparatus, when the fuel tank is sealed with the sealing valve, there may be a situation, for example, in which fuel within the fuel tank evaporates due to a rise in the ambient temperature or the like to raise the pressure inside the fuel tank. If the internal pressure of the fuel tank is elevated during refueling, a transpiration fuel is likely to be discharged to the outside when a fuel filler port is opened. To deal with this situation, a transpiration fuel treatment apparatus is available in which at the time of refueling, opening of the fuel filler port is temporarily prohibited and, during this period, the sealing valve (blocking valve) is opened to lower the internal pressure of the fuel tank to a predetermined pressure (see, for example, Patent Document 1).

PRIOR ART DOCUMENTS

Patent Documents

[Patent Document 1] Japanese Patent No. 4110932

SUMMARY OF THE INVENTION

Problems to be Solved by the Invention

By decreasing the internal pressure of the fuel tank, the discharge of the transpiration fuel during refueling can be suppressed. However, lowering the internal pressure of the fuel tank to a predetermined pressure (pressure relief) requires a relatively long time. A user of the vehicle to be refueled, therefore, is forced to wait for a relatively long time until the fuel filler port is opened, so that a problem may arise about convenience.

The pressure relief time of the fuel tank varies with the internal pressure of the fuel tank and the volume of the fuel tank. In the case of a vehicle loaded with a fuel tank of a relatively large volume for a long cruising distance, therefore, the pressure relief time may be lengthened further.

The present invention has been accomplished in the light of the above-described circumstances. It is an object of this invention to provide a transpiration fuel treatment apparatus which can lower the internal pressure of a fuel tank in a relatively short time at the time of refueling.

Means for Solving the Problems

A first aspect of the present invention for solving the above problems is a transpiration fuel treatment apparatus, comprising: a fuel tank loaded on a vehicle; a first sealing valve for sealing up a transpiration fuel within the fuel tank; a second sealing valve for sealing up the transpiration fuel within the fuel tank at a position different from a position of the first sealing valve; and an opening/closing control device for opening the first sealing valve and the second sealing valve before refueling of the fuel tank is started.

A second aspect of the present invention is the transpiration fuel treatment apparatus according to the first aspect, wherein the opening/closing control device closes one of the first sealing valve and the second sealing valve when an internal pressure of the fuel tank lowers to a predetermined pressure.

A third aspect of the present invention is the transpiration fuel treatment apparatus according to the second aspect, further comprising a detection device for detecting an open or closed state of a fuel filler port lid provided to cover a fuel filler port, wherein the opening/closing control device closes the other of the first sealing valve and the second sealing valve when it is detected by the detection device that the fuel filler port lid has changed from the open state into the closed state.

A fourth aspect of the present invention is the transpiration fuel treatment apparatus according to any one of the first to third aspects, further comprising an uncapping permission device which permits uncapping of a fuel filler port when an internal pressure of the fuel tank is brought to a predetermined pressure or lower under control of the opening/closing control device, wherein the uncapping permission device releases locking of a fuel filler port lid provided to cover the fuel filler port, when refueling is requested and the internal pressure of the fuel tank is the predetermined pressure or lower.

A fifth aspect of the present invention is the transpiration fuel treatment apparatus according to any one of the first to fourth aspects, wherein the opening/closing control device opens one of the first sealing valve and the second sealing valve when an internal pressure of the fuel tank exceeds a predetermined threshold value.

A sixth aspect of the present invention is the transpiration fuel treatment apparatus according to any one of the first to fifth aspects, further comprising a canister for adsorbing the transpiration fuel within the fuel tank, a leveling valve for detecting a liquid level of fuel within the fuel tank, and a first rollover valve for blocking a fuel path when the fuel tank rolls, wherein the first sealing valve has one side connected to the canister and another side connected to the leveling valve, and the second sealing valve has one side connected to the canister and another side connected to the first rollover valve.

A seventh aspect of the present invention is the transpiration fuel treatment apparatus according to the sixth aspect, further comprising a first transpiration fuel passage for connecting the first sealing valve and the canister, and a second transpiration fuel passage for connecting the second sealing valve and the canister, wherein the second transpiration fuel passage merges with the first transpiration fuel passage between the first sealing valve and the canister, and the opening/closing control device opens one of the first sealing valve and the second sealing valve when an internal pressure of the fuel tank exceeds a predetermined threshold value.

An eighth aspect of the present invention is the transpiration fuel treatment apparatus according to any one of the first to seventh aspects, further comprising a canister for adsorbing the transpiration fuel within the fuel tank, a first transpiration fuel passage for connecting the first sealing valve and the canister, a second transpiration fuel passage for connecting the second sealing valve and the canister, a third transpiration fuel passage to which the first transpiration fuel passage and the second transpiration fuel passage are connected, and which ranges from the canister and communicates with an intake passage of an internal combustion engine loaded on the vehicle, and a bypass valve which seals the canister and brings the first transpiration fuel passage and the second transpiration fuel passage into communication with the third transpiration fuel passage while bypassing the canister, wherein the opening/closing control device closes the bypass valve and seals the canister when an internal pressure of the fuel tank exceeds a predetermined threshold value.

Effects of the Invention

According to the transpiration fuel treatment apparatus of the present invention described above, the fuel tank and the canister are allowed to communicate via a plurality of the transpiration fuel passages at the time of refueling. Thus, the internal pressure of the fuel tank can be lowered to a predetermined pressure in a relatively short time, when refueling is requested, therefore, the fuel filler port can be opened in a relatively short time.

MODE FOR CARRYING OUT THE INVENTION

An embodiment of the present invention will be described in detail with reference to the accompanying drawings.

A transpiration fuel treatment apparatus according to the present invention is an apparatus which, for example, is loaded on a vehicle, such as a plug-in hybrid vehicle, for suppressing the discharge into the atmosphere of a transpiration fuel occurring within a fuel tank where fuel to be supplied to an engine is stored.

Figure 1:
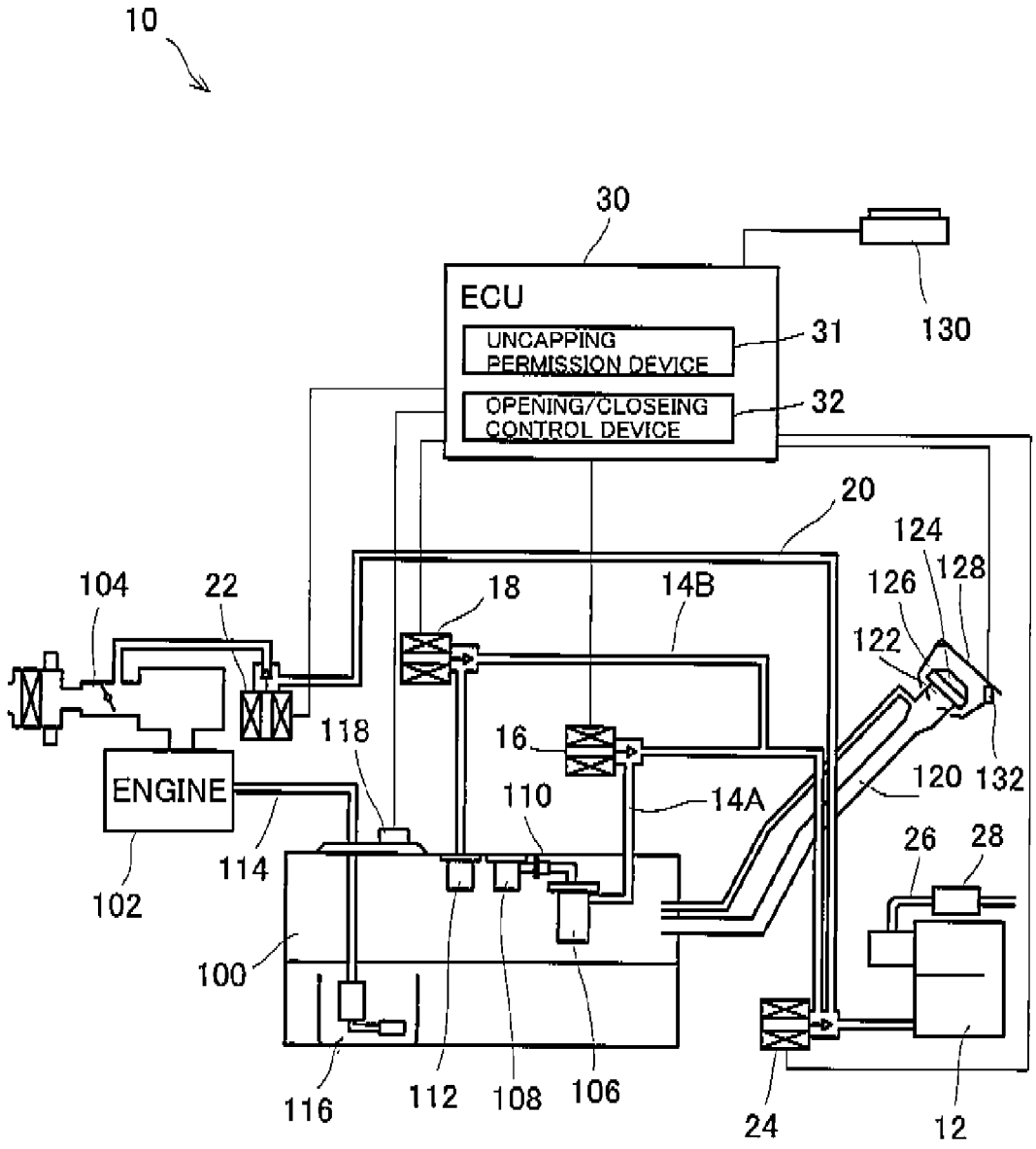
FIG. 1 is a view showing the schematic configuration of a transpiration fuel treatment apparatus according to an embodiment of the present invention.

As shown in FIG. 1, a transpiration fuel treatment apparatus 10 according to the present embodiment is equipped with a canister 12 having activated carbon enclosed therein to adsorb a transpiration fuel occurring in a fuel tank 100. The canister 12 is connected to the fuel tank 100 by first vapor piping (a first transpiration fuel passage) 14A and second vapor piping (a second transpiration fuel passage) 14B. In detail, the first vapor piping 14A has one end connected to a leveling valve 106 provided within the fuel tank 100, and the other end connected to the canister 12. The first vapor piping 14A is provided with a first sealing valve 16 for opening and closing the first vapor piping 14A.

The second vapor piping 14B has one end connected to the fuel tank 100 at a position different from the position where the one end of the first vapor piping 14A is connected to the fuel tank 100. In the present embodiment, the one end of the second vapor piping 14B is connected to a first rollover valve 108 provided above the leveling valve 106 within the fuel tank 100. The other end of the second vapor piping 14B is connected to the first vapor piping 14A at a location of the first vapor piping 14A between the first sealing valve 16 and the canister 12 and, in the present embodiment, at a location of the first vapor piping 14A between the first sealing valve 16 and a bypass valve to be described later. The second vapor piping 14B is provided with a second sealing valve 18 for opening and closing the second vapor piping 14B.

As described above, the transpiration fuel treatment apparatus 10 according to the present invention is equipped with the first sealing valve 16 for sealing up the transpiration fuel within the fuel tank 100, and the second sealing valve 18 for sealing up the transpiration fuel within the fuel tank 100 at a position different from the position of sealing with the first sealing valve 16.

The first sealing valve 16 and the second sealing valve 18 are driven, for example, by electromagnetic solenoids. Concretely, the first sealing valve 16 and the second sealing valve 18 are each composed of a so-called normally closed type electromagnetic valve. Each of these valves closes when the electromagnetic solenoid is not energized, and opens when the electromagnetic solenoid is energized.

The above-mentioned leveling valve 106 provided within the fuel tank 100 controls the liquid level of the fuel within the fuel tank 100 during refueling, and is disposed below the first rollover valve 108 in a vehicle body. In the present embodiment, moreover, a second rollover valve 112 is connected to the leveling valve 106 via a two-way valve 110. The second rollover valve 112 and the above-mentioned first rollover valve 108 prevent the outflow of the fuel from the fuel tank 100 to the outside by the action of float valves, whereas the two-way valve 110 restricts the amount of fuel supply during refueling in a state close to the fill-up of the fuel tank 100. Since the first rollover valve 108, the second rollover valve 112, and the two-way valve 110 are in the existing configurations, their detailed descriptions are omitted here. The fuel tank 100 is further provided with a fuel pump 116 for supplying fuel to a fuel injection valve (not shown) of an engine 102 via a fuel line 114, and a pressure sensor 118 for detecting the internal pressure of the fuel tank 100.

In the present embodiment, the first rollover valve 108 and the second rollover valve 112 are provided within the fuel tank 100, but the second rollover valve 112 may concurrently serve as the first rollover valve 108. That is, the one end of the second vapor piping 14B may be connected to the second rollover valve 112. In this case, however, adjustment of the flow rate of the second rollover valve 112 could be necessary.

The canister 12 is connected to an intake passage 104 of the engine 102 via purge piping (a third transpiration fuel passage) 20. That is, in the present embodiment, the fuel tank 100 is connected to the intake passage 104 of the engine 102 by the first vapor piping (first transpiration fuel passage) 14A, the second vapor piping (second transpiration fuel passage) 14B, and the purge piping (third transpiration fuel passage) 20. The purge piping 20 is provided with a purge valve 22, which opens and closes the purge piping 20, near the end thereof toward the engine 102. In the vicinity of the end of the purge piping 20 facing the canister 12, namely, at the junction of the purge piping 20 and the first vapor piping 14A with the canister 12, a bypass valve 24 is provided for cutting off the communication of the canister 12 with, the purge piping 20 and the first vapor piping 14A. When the communication between the canister 12 and the purge piping 20/first vapor piping 14A is thus blocked by the bypass valve 24, the transpiration fuel within the fuel tank 100 bypasses the canister 12 and is supplied to the intake passage 104 via the first vapor piping 14A, the second vapor piping 14B, and the purge piping 20.

A vent line 26 is connected to the canister 12, and the canister 12 communicates with the outside air via the vent line 26. An air filter 28 is provided midway through the vent line 26. The purge valve 22 is composed of a so-called normally closed type electromagnetic valve as is each of the first sealing valve 16 and the second sealing valve 18. The bypass valve 24, on the other hand, is a so-called normally open type electromagnetic valve, and opens when the electromagnetic solenoid is not energized, but closes when the electromagnetic solenoid is energized.

To the fuel tank 100, a filler pipe 20 is connected for supplying fuel into the fuel tank 100. A fuel filler port 122 is provided at the end of the filler pipe 120 on a side opposite to the fuel tank 100. The fuel filler port 122 is configured to be sealable with a fuel filler port cap 124. The fuel filler port 122 is formed within a concavity 126, and the opening of the concavity 126 is adapted to be openable and closable by a fuel filler port lid 128. In the present embodiment, for example, the fuel filler port lid 128 is adapted to be held in a closed state by a locking mechanism (not shown), and to enter an open state upon release of the locking mechanism by the operation of an opening switch 130 provided on a driver's seat of a vehicle. Near the opening of the concavity 126, a lid sensor (detection device) 132 for detecting the open and closed states of the fuel filler port lid 128.

The transpiration fuel treatment apparatus 10 according to the present embodiment, as described above, has the first vapor piping 14A adapted to be openable and closable by the first sealing valve 16, and the second vapor piping 14B adapted to be openable and closable by the second sealing valve 18. As will be described in detail later, therefore, an ECU (electronic control unit) 30 controls, as appropriate, the actions of the first sealing valve 16, the second sealing valve 18, etc., thereby enabling the internal pressure of the fuel tank 100 to be lowered to a predetermined pressure in a relatively short time at the time of refueling. Thus, the fuel filler port 122 can be opened in a relatively short time after refueling is requested. Furthermore, excessive refueling (over-refueling) can also be suppressed properly.

The ECU 30 has an input/output device, a storage device for storage of a control program and a control map, a central processing unit, timers and counters and, based on information from various sensors, exercises integrated control over the engine 102 including the transpiration fuel treatment apparatus 10. The ECU 30, concretely, has an uncapping permission device 31 and an opening/closing control device 32 which constitute a part of the transpiration fuel treatment apparatus 10.

The uncapping permission device 31 permits the uncapping of the fuel filler port 122, namely, the opening of the fuel filler port cap 124, if predetermined permission conditions are established when a request for refueling is made by an user. In the present embodiment, when the user operates the opening switch 130, as an indication of a request for refueling, the uncapping permission device 31 releases the locking mechanism for the fuel filler port lid 128 if the predetermined permission conditions are established, thereby permitting the uncapping of the fuel filler port 122. The permission conditions include at least the internal pressure of the fuel tank 100 being a predetermined pressure (atmospheric pressure in the present embodiment) or lower.

The opening/closing control device 32 controls, as appropriate, the open or closed state of the purge valve 22, the bypass valve 24, the first sealing valve 16, and the second sealing valve 18, based on detection information from the various sensors including the above-mentioned pressure sensor 118 and lid sensor 132.

An example of opening/closing control over the purge valve 22, the bypass valve 24, the first sealing valve 16, and the second sealing valve 18, especially, the opening/closing control over the first sealing valve 16 and the second sealing valve 18, by the opening/closing control device 32 at the time of refueling will be described by reference to a timing chart in FIG. 2.

Figure 2:
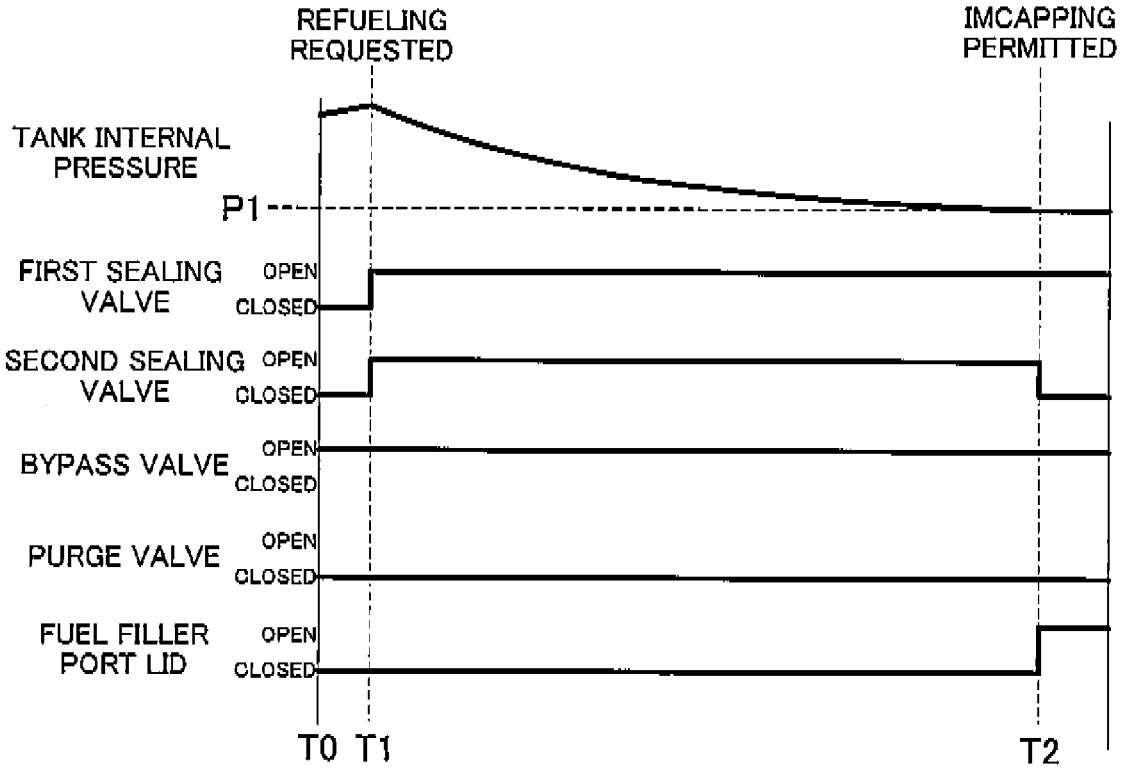
FIG. 2 is a timing chart showing changes in a tank internal pressure, and the courses of the open or closed state of each valve and the open or closed state of a fuel filler port lid when refueling is requested.

As shown in FIG. 2, the first sealing valve 16 and the second sealing valve 18 are both closed until the operation of the opening switch 130 is performed by the vehicle user, namely, until a "request for refueling" is made by the user (time period T0-T1).

At time T1, the opening switch 130 is operated. If, at this time, the internal pressure of the fuel tank 100 (tank internal pressure) is higher than a predetermined pressure (in the present embodiment, atmospheric pressure) P1, the uncapping permission device 31 judges that the aforementioned permission conditions have not been established, and holds the fuel filler port lid 128 in a closed state, without permitting the uncapping of the fuel filler port 122. At the same time, the opening/closing control device 32 opens the first sealing valve 16 and the second sealing valve 18 that have been closed. That is, the opening/closing control device 32 opens the first sealing valve 16 and the second sealing valve 18 before the fuel tank 100 starts to be refueled. The open or closed state of the purge valve 22 and the bypass valve 24 is held as such without being changed. In detail, the purge valve 22, an electromagnetic valve of a so-called normally closed type, is held in a closed state, while the bypass valve 24, an electromagnetic valve of a so-called normally open type, is held in an open state.

In the above open or closed state of each valve, the fuel tank 100 and the canister 12 are brought into communication by the first vapor piping 14A and the second vapor piping 14B. A transpiration gas including the transpiration fuel within the fuel tank 100 flows into the canister 12 via the first vapor piping 14A and the second vapor piping 14B. As the transpiration gas flows into the canister 12, the internal pressure of the fuel tank 100 gradually decreases. At time T2, when the internal pressure of the fuel tank 100 lowers to the predetermined pressure P1, the uncapping permission device 31 permits the uncapping of the fuel filler port 122, thus switching the fuel filler port lid 128 from the closed state to an open state. That is, the locking mechanism is released, whereby the fuel filler port lid 128 becomes openable manually. At the same time, the opening/closing control device 32 closes the second sealing valve 18, while leaving the first sealing valve 16 open, of the first sealing valve 16 and the second sealing valve 18 that have been opened at the time T1. On this occasion, the first sealing valve 16 may be closed instead of the second sealing valve 18.

The transpiration fuel treatment apparatus 10, as described above, is equipped with the first vapor piping 14A and the second vapor piping 14B and, in the present embodiment, is adapted to open the first sealing valve 16 and the second sealing valve 18 when refueling is requested. By so doing, a relatively large amount of a transpiration gas per unit time can be flowed from the fuel tank 100 into the canister 12. Thus, the internal pressure of the fuel tank 100 can be lowered to the predetermined pressure P1 in a relatively short time. That is, after refueling is requested, the fuel filler port lid 128 can be opened in a relatively short time. Hence, the wait time of the user at the time of refueling can be shortened to improve convenience.

In the present embodiment, moreover, the second sealing valve 18 is closed at a time when the fuel filler port lid 128 is opened (time T2). Thus, the fuel filler port lid 128 can be opened in a relatively short time after a request for refueling and, as will be described later, over-refueling can also be suppressed properly.

Figure 3:
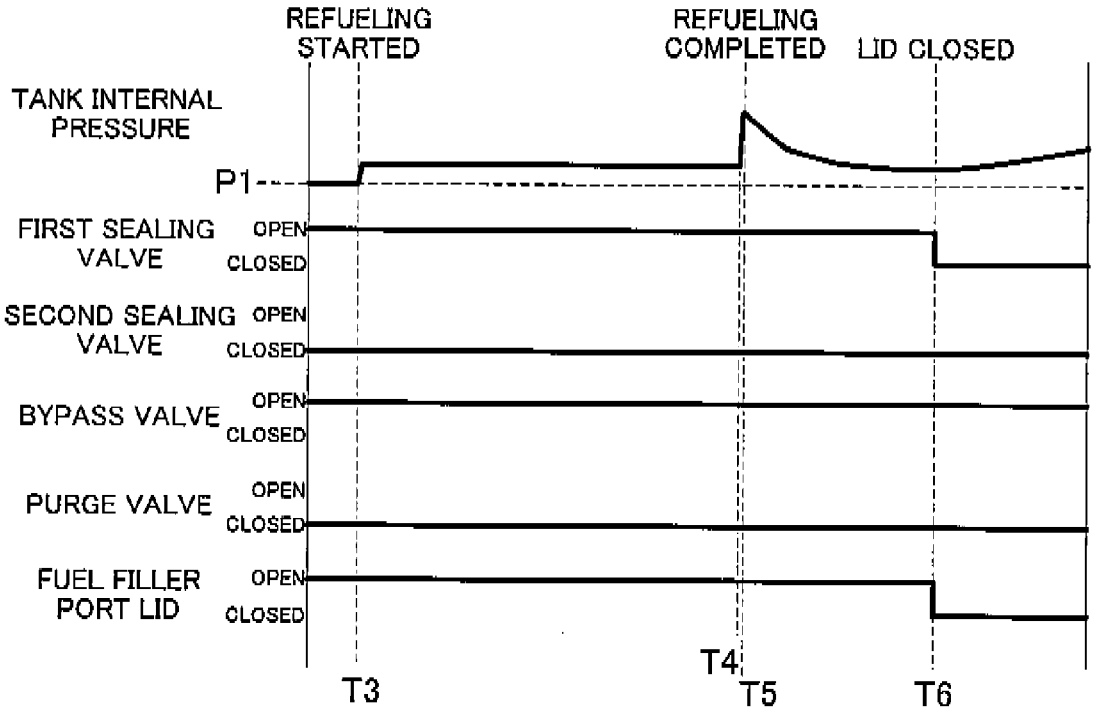
FIG. 3 is a timing chart showing changes in the tank internal pressure, and the course of the open or closed state of each valve during refueling.

An example of opening/closing control over each of the valves during refueling will be described by reference to a timing chart in FIG. 3.

As described above, at the time T2 when the internal pressure of the fuel tank 100 has lowered to the predetermined pressure P1, the second sealing valve 18 connected to the first rollover valve 108 is closed, while only the first sealing valve 16 connected to the leveling valve 106 is open. When refueling is started (time T3) in this state, the pressure inside the fuel tank 100 becomes slightly higher than the predetermined pressure P1 and stabilizes, as shown in FIG. 3. Then, the fuel within the fuel tank 100 increases upon refueling and, when the leveling valve 106 is closed (time T4), the evaporative gas within the fuel tank 100 flows from the leveling valve 106 into the first vapor piping 14A via the second rollover valve 112 and the two-way valve 110. At this time, a pressure loss in the two-way valve 110 is so great that the internal pressure of the fuel tank 100 abruptly rises. In accordance with this rise in the internal pressure of the fuel tank 100, the fuel within the fuel tank 100 is gradually raised within the filler pipe 120. The fuel raised in the filler pipe 120 touches a sensor at the leading end of a fueling gun (not shown), whereby refueling stops automatically (time T5).

With the present embodiment, only the first sealing valve 16 is opened, and the second sealing valve 18 is closed, during refueling, so that over-refueling can be suppressed properly. That is, refueling can be automatically stopped at a proper timing. If the first sealing valve 16 and the second sealing valve 18 are both opened during refueling, for example, there is a possibility that the internal pressure of the fuel tank 100 will not rise sharply, but automatic stoppage of refueling will be delayed, even after closing of the leveling valve 106 at the time T4. Since the second sealing valve 18 is closed during refueling, by contrast, refueling can be automatically stopped at a desired timing, and over-refueling can be suppressed appropriately.

The transpiration fuel treatment apparatus 10 according to the present invention, as described above, exhibits the actions and effects that the internal pressure of the fuel tank 100 can be lowered in a relatively short time when refueling is requested, and that over-refueling can be appropriately suppressed during refueling.

After refueling automatically stops, at T6, the fuel filler port lid 128 is closed by the user, that is, closing of the fuel filler port lid 128 is detected by the lid sensor 132. In accordance with this action, the first sealing valve 16 is closed. In other words, all the sealing valves are closed, completing a series of opening/closing control operations in refueling.

On condition that the fuel filler port lid 128 is closed, both the first sealing valve 16 and the second sealing valve 18 are closed, as mentioned above. Consequently, the completion of refueling can be properly determined, and both of the sealing valves can be reliably closed in conformity with the completion of refueling.

In the present embodiment, moreover, at the time of refueling, the first sealing valve 16 and the second sealing valve 18 are opened to lower the internal pressure of the fuel tank 100. Furthermore, when the internal pressure of the fuel tank 100 exceeds a predetermined threshold while the engine 102 is in operation, a so-called tank purge is performed in which at least one of the first sealing valve 16 and the second sealing valve 18 is opened to lower the internal pressure of the fuel tank 100. By so performing the tank purge at a predetermined timing, damage to the fuel tank 100 can be suppressed.

Figure 4:
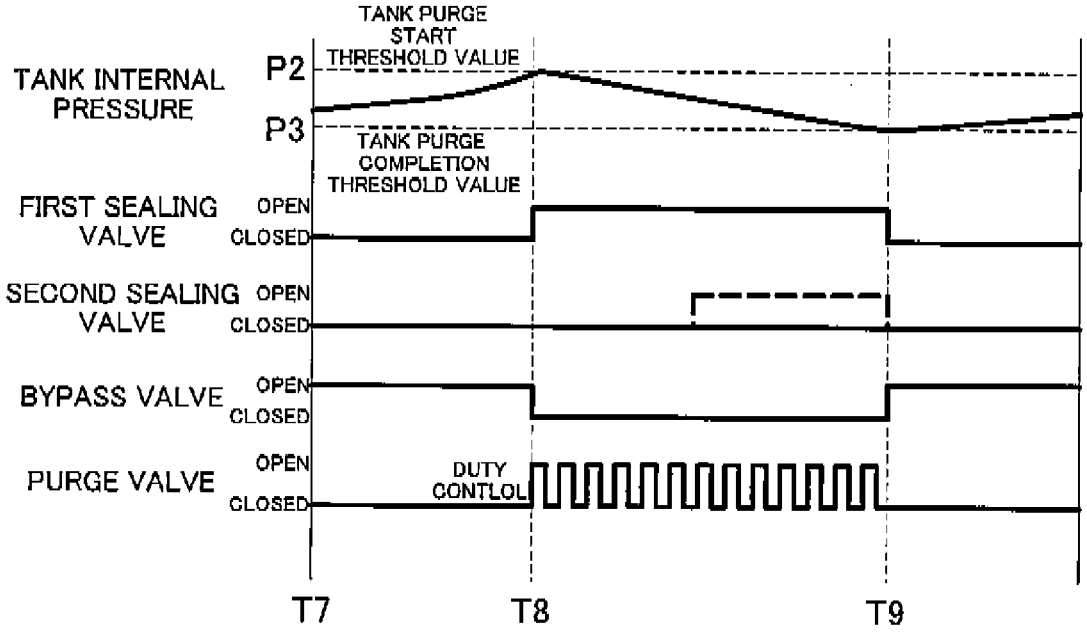
FIG. 4 is a timing chart showing changes in the tank internal pressure, and the course of the open or closed state of each valve in a tank purge.

FIG. 4 is a timing chart showing an example of the tank internal pressure and the open or closed state of each valve in the tank purge.

As shown in FIG. 4, even while the engine 102 is in operation, the first sealing valve 16 and the second sealing valve 18 are both closed, when the internal pressure of the fuel tank 100 (tank internal pressure) is lower than a predetermined threshold value P2 (time period T7-T8). At time T8, when the internal pressure of the fuel tank 100 reaches a predetermined threshold value (tank purge start threshold value) P2, the opening/closing control device 32 closes the bypass valve 24, and opens at least one of the first sealing valve 16 and the second sealing valve 18. In the present embodiment, only the first sealing valve 16 provided in the first vapor piping 14A, whose pipe line length is the shortest in the range from the fuel tank 100 to the engine 102, is opened. Further, the purge valve 22 is intermittently opened. The opening and closing of the purge valve 22 are subjected to duty control based on an air-fuel ratio.

By so controlling the open or closed state of each valve in the tank purge, the internal pressure of the fuel tank 100 can be lowered to suppress damage to the fuel tank 100.

Here, it is possible to lower the internal pressure of the fuel tank 100 even by opening only the second sealing valve 18, or both of the first sealing valve 16 and the second sealing valve 18, at the time of performing the tank purge. However, it is preferred to open only the first sealing valve 16 provided in the first vapor piping 14A, whose pipe line length up to the engine 102 is the shortest, as in the present embodiment. By this measure, the evaporative gas within the fuel tank 100 can be discharged efficiently. This procedure is effective, particularly, immediately after start of the tank purge. Thus, it is permissible, for example, to open only the first sealing valve 16 at the time T8 and, as indicated by a dashed line in the drawing, open the second, sealing valve 18 after a lapse of a predetermined period of time.

Then, at a time when the internal pressure of the fuel tank 100 lowers to a predetermined threshold value (tank purge completion threshold value) P3 (time T9), the bypass valve 24 is opened, and the first sealing valve 16 is closed. Further, the duty control over the purge valve 22 is discontinued, and the closed state of this valve is maintained. In this manner, a series of the opening/closing control actions on each valve in the tank purge is terminated.

The present invention has been described above in regard to one embodiment thereof, but it is to be understood that the present invention is in no way limited to this embodiment. The present invention can be changed or modified, as appropriate, without departing from its spirit and scope.

The present embodiment, for example, has illustrated the configuration in which the fuel tank 100 and the canister 12 are connected together by the two purge piping lines, i.e., the first vapor piping 14A and the second vapor piping 142. However, a configuration in which they are connected by three or more purge piping lines may be adopted. Even such a configuration can provide the same actions and effects as those in the foregoing embodiment.

In the above-described embodiment, when refueling is requested, the second sealing valve 18 is closed, at a time when the tank pressure lowers to the predetermined pressure P1 and the fuel filler port lid 128 is opened. However, the timing of closing the second sealing valve 18 is not limited to this timing. The second sealing valve 18 may be closed at an earlier timing than the timing at which the tank pressure starts to rise during refueling (the time T4 in FIG. 3). By so doing, over-refueling can be suppressed properly.

The above-mentioned embodiment has also illustrated the configuration in which the first sealing valve 16 is provided in the first vapor piping 14A, and the second sealing valve 18 is provided in the second vapor piping 142. The present invention, however, is not limited to such a configuration. It suffices for the first sealing valve 16 to be provided so as to seal up the transpiration fuel in the fuel tank 100, and the second sealing valve 18 may be one which seals up the transpiration fuel within the fuel tank 100 at a position different from the position of the first sealing valve 16. Hence, the first sealing valve 16 and the second sealing valve 18 may be those provided, for example, in the fuel tank 100 itself.

EXPLANATIONS OF LETTERS OR NUMERALS

10 Transpiration fuel treatment apparatus
12 Canister
14A First vapor piping
14B Second vapor piping
16 First sealing valve
18 Second sealing valve
20 Purge piping
22 Purge valve
24 Bypass valve
26 Vent line
28 Air filter
100 Fuel tank
102 Engine
104 Intake passage
106 Leveling valve
108 First rollover valve
110 Two-way valve
112 Second rollover valve
114 Fuel line
116 Fuel pump
118 Pressure sensor
120 Filler pipe
122 Fuel filler port
124 Fuel filler port cap
126 Concavity
128 Fuel filler port lid
130 Opening switch
132 Lid sensor

The invention claimed is:

1. A transpiration fuel treatment apparatus, comprising:
a fuel tank loaded on a vehicle;
a first sealing valve for sealing up a transpiration fuel within the fuel tank;
a second sealing valve for sealing up the transpiration fuel within the fuel tank at a position different from a position of the first sealing valve; and
an opening/closing control device that opens the first sealing valve and the second sealing valve before refueling of the fuel tank is started.

2. The transpiration fuel treatment apparatus according to claim 1, wherein
the opening/closing control device closes one of the first sealing valve and the second sealing valve when an internal pressure of the fuel tank lowers to a predetermined pressure.

3. The transpiration fuel treatment apparatus according to claim 2,
further comprising a detection device that detects an open or closed state of a fuel filler port lid provided to cover a fuel filler port,
wherein the opening/closing control device closes other of the first sealing valve and the second sealing valve when it is detected by the detection device that the fuel filler port lid has changed from the open state to the closed state.

4. The transpiration fuel treatment apparatus according to claim 1,
further comprising an uncapping permission device that permits uncapping of a fuel filler port when an internal pressure of the fuel tank is brought to a predetermined pressure or lower under control of the opening/closing control device,
wherein the uncapping permission device releases locking of a fuel filler port lid provided to cover the fuel filler port, when refueling is requested and the internal pressure of the fuel tank is the predetermined pressure or lower.

5. The transpiration fuel treatment apparatus according to claim 2,
further comprising an uncapping permission device that permits uncapping of a fuel filler port when an internal pressure of the fuel tank is brought to a predetermined pressure or lower under control of the opening/closing control device,
wherein the uncapping permission device releases locking of a fuel filler port lid provided to cover the fuel filler port, when refueling is requested and the internal pressure of the fuel tank is the predetermined pressure or lower.

6. The transpiration fuel treatment apparatus according to claim 3,
further comprising an uncapping permission device that permits uncapping of a fuel filler port when an internal pressure of the fuel tank is brought to a predetermined pressure or lower under control of the opening/closing control device, wherein the uncapping permission device releases locking of a fuel filler port lid provided to cover the fuel filler port, when refueling is requested and the internal pressure of the fuel tank is the predetermined pressure or lower.

7. The transpiration fuel treatment apparatus according to claim 1, wherein the opening/closing control device opens one of the first sealing valve and the second sealing valve when an internal pressure of the fuel tank exceeds a predetermined threshold value.

8. The transpiration fuel treatment apparatus according to claim 2, wherein the opening/closing control device opens one of the first sealing valve and the second sealing valve when an internal pressure of the fuel tank exceeds a predetermined threshold value.

9. The transpiration fuel treatment apparatus according to claim 3, wherein the opening/closing control device opens one of the first sealing valve and the second sealing valve when an internal pressure of the fuel tank exceeds a predetermined threshold value.

10. The transpiration fuel treatment apparatus according to claim 4, wherein the opening/closing control device opens one of the first sealing valve and the second sealing valve when an internal pressure of the fuel tank exceeds a predetermined threshold value.

11. The transpiration fuel treatment apparatus according to claim 1, further comprising a canister for adsorbing the transpiration fuel within the fuel tank, a leveling valve for detecting a liquid level of fuel within the fuel tank, and a first rollover valve for blocking a fuel path when the fuel tank rolls, wherein the first sealing valve has one side connected to the canister and another side connected to the leveling valve, and the second sealing valve has one side connected to the canister and another side connected to the first rollover valve.

12. The transpiration fuel treatment apparatus according to claim 2, further comprising a canister for adsorbing the transpiration fuel within the fuel tank, a leveling valve for detecting a liquid level of fuel within the fuel tank, and a first rollover valve for blocking a fuel path when the fuel tank rolls, wherein the first sealing valve has one side connected to the canister and another side connected to the leveling valve, and the second sealing valve has one side connected to the canister and another side connected to the first rollover valve.

13. The transpiration fuel treatment apparatus according to claim 3, further comprising a canister for adsorbing the transpiration fuel within the fuel tank, a leveling valve for detecting a liquid level of fuel within the fuel tank, and a first rollover valve for blocking a fuel path when the fuel tank rolls, wherein the first sealing valve has one side connected to the canister and another side connected to the leveling valve, and the second sealing valve has one side connected to the canister and another side connected to the first rollover valve.

14. The transpiration fuel treatment apparatus according to claim 4, further comprising a canister for adsorbing the transpiration fuel within the fuel tank, a leveling valve for detecting a liquid level of fuel within the fuel tank, and a first rollover valve for blocking a fuel path when the fuel tank rolls, wherein the first sealing valve has one side connected to the canister and another side connected to the leveling valve, and the second sealing valve has one side connected to the canister and another side connected to the first rollover valve.

15. The transpiration fuel treatment apparatus according to claim 11, further comprising a first transpiration fuel passage for connecting the first sealing valve and the canister, and a second transpiration fuel passage for connecting the second sealing valve and the canister, wherein the second transpiration fuel passage merges with the first transpiration fuel passage between the first sealing valve and the canister, and the opening/closing control device opens one of the first sealing valve and the second sealing valve when an internal pressure of the fuel tank exceeds a predetermined threshold value.

16. The transpiration fuel treatment apparatus according to claim 12, further comprising a first transpiration fuel passage for connecting the first sealing valve and the canister, and a second transpiration fuel passage for connecting the second sealing valve and the canister, wherein the second transpiration fuel passage merges with the first transpiration fuel passage between the first sealing valve and the canister, and the opening/closing control device opens one of the first sealing valve and the second sealing valve when an internal pressure of the fuel tank exceeds a predetermined threshold value.

17. The transpiration fuel treatment apparatus according to claim 1, further comprising a canister for adsorbing the transpiration fuel within the fuel tank, a first transpiration fuel passage for connecting the first sealing valve and the canister, a second transpiration fuel passage for connecting the second sealing valve and the canister, a third transpiration fuel passage to which the first transpiration fuel passage and the second transpiration fuel passage are connected, and which ranges from the canister and communicates with an intake passage of an internal combustion engine loaded on the vehicle, and a bypass valve which seals the canister and brings the first transpiration fuel passage and the second transpiration fuel passage into communication with the third transpiration fuel passage while bypassing the canister, wherein the opening/closing control device closes the bypass valve and seals the canister when an internal pressure of the fuel tank exceeds a predetermined threshold value.

18. The transpiration fuel treatment apparatus according to claim 2, further comprising a canister for adsorbing the transpiration fuel within the fuel tank, a first transpiration fuel passage for connecting the first sealing valve and the canister, a second transpiration fuel passage for connecting the second sealing valve and the canister, a third transpiration fuel passage to which the first transpiration fuel passage and the second, transpiration fuel passage are connected, and which ranges from the canister and communicates with an intake passage of an internal combustion engine loaded on the vehicle, and a bypass valve which seals the canister and brings the first transpiration fuel passage and the second transpiration fuel passage into communication with the third transpiration fuel passage while bypassing the canister, wherein the opening/closing control device closes the bypass valve and seals the canister when the internal pressure of the fuel tank exceeds a predetermined threshold value.

19. The transpiration fuel treatment apparatus according to claim 3, further comprising a canister for adsorbing the transpiration fuel within the fuel tank, a first transpiration fuel passage for connecting the first sealing valve and the canister, a second transpiration fuel passage for connecting the second sealing valve and the canister, a third transpiration fuel passage to which the first transpiration fuel passage and the second transpiration fuel passage are connected, and which ranges from the canister and communicates with an intake passage of an internal combustion engine loaded on the vehicle, and a bypass valve which seals the canister and brings the first transpiration fuel passage and the second transpiration fuel passage into communication with the third transpiration fuel passage while bypassing the canister, wherein the opening/closing control device closes the bypass valve and seals the canister when the internal pressure of the fuel tank exceeds a predetermined threshold value.

20. The transpiration fuel treatment apparatus according to claim 4, further comprising a canister for adsorbing the transpiration fuel within the fuel tank, a first transpiration fuel passage for connecting the first sealing valve and the canister, a second transpiration fuel passage for connecting the second sealing valve and the canister, a third transpiration fuel passage to which the first transpiration fuel passage and the second transpiration fuel passage are connected, and which ranges from the canister and communicates with an intake passage of an internal combustion engine loaded on the vehicle, and a bypass valve which seals the canister and brings the first transpiration fuel passage and the second transpiration fuel passage into communication with the third transpiration fuel passage while bypassing the canister, wherein the opening/closing control device closes the bypass valve and seals the canister when the internal pressure of the fuel tank exceeds a predetermined threshold value.

* * * * *